US008491229B2

(12) United States Patent
Cornelius

(10) Patent No.: US 8,491,229 B2
(45) Date of Patent: Jul. 23, 2013

(54) HEAVY DUTY WEAR BAND FOR PNEUMATIC TRANSPORT

(75) Inventor: Chad David Cornelius, Highlands Ranch, CO (US)

(73) Assignee: Translogic Corporation, Denver, CO (US)

( * ) Notice: Subject to any disclaimer, the term of this patent is extended or adjusted under 35 U.S.C. 154(b) by 483 days.

(21) Appl. No.: 12/727,120

(22) Filed: Mar. 18, 2010

(65) Prior Publication Data

US 2010/0247251 A1 Sep. 30, 2010

Related U.S. Application Data

(60) Provisional application No. 61/163,350, filed on Mar. 25, 2009.

(51) Int. Cl.
*B65G 51/06* (2006.01)

(52) U.S. Cl.
USPC ..... 406/190

(58) Field of Classification Search
USPC ..... 406/190
See application file for complete search history.

(56) References Cited

U.S. PATENT DOCUMENTS

| | | | | |
|---|---|---|---|---|
| 3,787,008 | A | 1/1974 | Barnett et al. | |
| 3,907,231 | A * | 9/1975 | Kreiner | 406/19 |
| 3,986,590 | A | 10/1976 | Lapidus et al. | |
| 4,324,511 | A * | 4/1982 | Irish | 406/189 |
| 5,181,807 | A | 1/1993 | Anders | |
| 5,538,366 | A | 7/1996 | Piland et al. | |
| 5,562,591 | A | 10/1996 | Marchand et al. | |
| 5,573,356 | A | 11/1996 | Henderson | |
| 5,655,677 | A | 8/1997 | Fratello et al. | |
| 5,901,966 | A | 5/1999 | Valerino, Sr. et al. | |
| 5,980,164 | A | 11/1999 | Fratello | |
| 6,015,246 | A | 1/2000 | Yamane et al. | |
| 6,565,290 | B2 * | 5/2003 | Smith | 406/188 |
| 7,661,910 | B2 * | 2/2010 | Guenther | 406/142 |
| 2002/0150432 | A1 * | 10/2002 | Smith et al. | 406/188 |
| 2007/0269295 | A1 * | 11/2007 | Guenther | 414/221 |
| 2010/0104381 | A1 * | 4/2010 | Guenther | 406/184 |

FOREIGN PATENT DOCUMENTS

| | | |
|---|---|---|
| JP | 05330650 | 12/1993 |
| JP | 09077252 | 3/1997 |

* cited by examiner

*Primary Examiner* — Joseph A Dillon, Jr.
(74) *Attorney, Agent, or Firm* — Marsh Fischmann & Breyfogle LLP; Russell T. Manning

(57) ABSTRACT

Provided herein are pneumatic carriers for use in high speed and/or heavy payload pneumatic carrier transport applications. The carriers incorporate thermally conductive wear bands to remove heat from areas of high friction to areas of low friction and thereby reduce the wear rate of the wear band. In one arrangement, the wear band includes a metallic wire impregnated cloth having metallic wires woven into the matrix of a textile, which forms the wear band. In one embodiment, the wire impregnated within the textile may extend around at least a portion of a carrier such that the wires can transfer heat from a location of high friction (e.g., a bearing surface beneath a carrier) to a location of low friction.

14 Claims, 6 Drawing Sheets

HEAVY DUTY WEAR BAND FOR PNEUMATIC TRANSPORT

CROSS REFERENCE

This application claims the benefit of the filing date of U.S. Provisional Application No. 61/163,350 entitled: "High Duty Wear Band for Pneumatic Transport" having a filing date of Mar. 25, 2009, the entire contents of which is incorporated herein.

FIELD

The present disclosure generally relates to carriers for use in pneumatic tube transport systems, and, in particular, to wear bands for carriers for use in high speed and/or heavy load pneumatic tube applications.

BACKGROUND

Generally, pneumatic tube transport systems convey materials between discrete points or stations. A carrier is positionable within a number of sealed tubes of the pneumatic tube transport system to transport products, documents, or other items. The carrier passes through the tubes by creating a zone of higher pressure air behind the carrier than exists in front of the carrier. A vacuum/zone of negative pressure in front of the carrier or a zone of positive pressure behind the carrier creates this pressure differential.

Accelerator rings or seal/wear bands on the carriers prevent excessive transfer (i.e., bypass) of air between the front of the carrier and the rear of the carrier. Seal/wear bands thus maintain the differential pressure between the front and rear portions of a carrier, which provides the force necessary to propel the carrier through the pneumatic tube system. Such seal bands typically engage the inner surface of the transport tube to support the carrier body and to inhibit air flow between the front and rear portions of the carrier. In this regard, it is important to minimize friction between the seal bands and the inner wall of the tube to enable the carrier to move through the tube without requiring high differential pressures between the front and rear of the carrier.

The size of the carrier and/or the intended payload of a carrier may affect the choice of materials for a seal/wear band. In this respect, soft, resilient materials, such as felt or cloth belting, may form wear bands for small diameter carriers transferring light loads. Such materials adapt closely to the inner surface of the transfer tube and are pliable enough to conform to surface irregularities within the tube. However, such materials do not provide sufficient load carrying capability when used with large diameter carriers designed for transferring heavy loads. Under such conditions, such materials may wear rapidly and/or crush, which may permit excessive air by-pass around the carrier.

Larger carriers or carriers designed to transport heavier payloads typically require a more rigid, wear resistant material to support their weight. For such applications, hard rubber or rubber reinforced leather belting sometimes form the seal/wear band. While such materials generally provide greater wear resistance, they are typically rigid and inflexible, and do not readily conform to surface irregularities (e.g., pipe junctions) within the transfer tube. Further, standard commercially available, metal or plastic tubes form most transfer tubes of pneumatic systems. Such tubes are available in various nominal sizes and are subject to manufacturing tolerances, which can vary the inner diameter of such tubes. Moreover, such tubes are generally not perfectly round. In this respect, most nominal sizes of tubing, especially metal tubing, have an ovality factor that is a dimension indicative of the degree or amount by which a cylindrical tube may be out-of-round. Accordingly, if a wear band is too rigid, it can cause the carrier to bind within the pneumatic tubes.

SUMMARY

The inventor has recognized that in certain applications, existing wear bands prematurely degrade. Such applications include high-speed and/or heavy payload applications that tend to melt or abrade standard wear bands. The inventor has also recognized that the ability to remove heat from areas of heat buildup within the wear band may improve the wear characteristics and structural integrity thereof. Accordingly, the inventor has recognized that wear bands formed of thermally conductive textiles may allow for removing heat from the wear band while also withstanding the friction associated with high-speed and/or heavy payload applications and allowing a carrier to move through a pneumatic tube system without undue resistance. In this regard, such thermally conductive textiles provide adequate wear resistance, crush resistance and/or flexibility to accommodate tube imperfections/variations while providing a sufficiently low friction contact between a carrier and a pneumatic tube.

In one aspect, a metallic wire impregnated textile forms one or both wear bands of a pneumatic carrier. Such a carrier typically includes a generally cylindrical containment vessel that defines an enclosed space and which includes at least a first access into the enclosed space. The carrier also includes first and second seal bands interconnected with an outer surface of the containment vessel at first and second axial locations. Such wear bands substantially encircle the containment vessel. At least one of the wear bands includes a wire impregnated textile material wherein wires within the textile material extend around a portion of the circumference of the containment vessel. By extending around the circumference of the carrier vessel, these wires may conduct heat away from a high friction area to a lower friction area and thereby reduce heat buildup in areas of high friction (e.g., below a carrier) during transport.

In one arrangement, the wires impregnated within the textile material may extend along substantially the entire length of the textile material. For instance, if the textile material forms a continuous annulus, the wires may be continuous around the annulus. Alternatively, if the textile material is an elongated material disposed around the containment vessel such that first and second ends of the textile material abut, the wires may extend from the first end to the second end of the textile material. In any arrangement, it may be desirable that the wires extend for at least one-fourth to one-third (e.g., two radians) of the circumference of the carrier. In this regard, wires located beneath the carrier during transport may be long enough to conduct heat to a lower friction area of the wear band, for instance, to a side area of the carrier.

The wires within the textile fabric may be of various different compositions. That is, the wires include, without limitation, steels, other metallic elements (e.g., copper, aluminum, etc) and/or alloys. For instance, one arrangement utilizes brass wires due to their high heat transfer coefficient and low hardness value. In any arrangement, it may be desirable that the wires within the textile material have a hardness that is less than the hardness of the pneumatic tubes in which the carrier will be utilized. This may prevent scarring or other damage to the inside surface of the tube.

The textile fabric may be any appropriate material. In one arrangement, cotton fiber may be utilized. In a further arrangement, non-organic materials may be utilized. Such non-organic materials may include, without limitation, aramid fibers. In one arrangement, the textile is a woven textile. Such woven textiles may reduce the contact between the wear band and the inside surface of a pneumatic tube, thereby reducing the frictional resistance of the wear band.

The containment vessel may be an end-opening carrier or side-opening carrier. That is, in a side-opening arrangement, first and second shells hingedly connected along a lateral edge collectively form the carrier. In such an arrangement, the wear bands may include first and second half cylindrical portions that, when the first and second shell closed, form a substantially continuous wear band around the outside surface of the containment vessel.

According to another aspect, a thermally conductive fabric forms one or both wear bands of a pneumatic carrier. Such a pneumatic carrier includes a containment vessel that includes first and second seal bands interconnected to its outer surface. One more of the seal bands are made from a woven textile material having a first set of thermally conductive fibers that extend around a portion of the circumference of the containment vessel. At least a portion of this first set of thermally conductive fibers has a thermal conductivity of at least 15 w/mK. The thermally conductive fibers may be formed of organic fibers (e.g., carbon fibers, graphite fibers, etc.) that provide desired thermal conductivity. In other arrangements, these fibers may be formed of metallic fibers or wires.

DETAILED DESCRIPTION

Reference will now be made to the accompanying drawings, which at least assist in illustrating the various pertinent features of the present invention. In this regard, the following description is presented for purposes of illustration and description. Furthermore, the description is not intended to limit the invention to the form disclosed herein. Consequently, variations and modifications commensurate with the following teachings, and skill and knowledge of the relevant art, are within the scope of the present invention.

Pneumatic System

Figure 1:
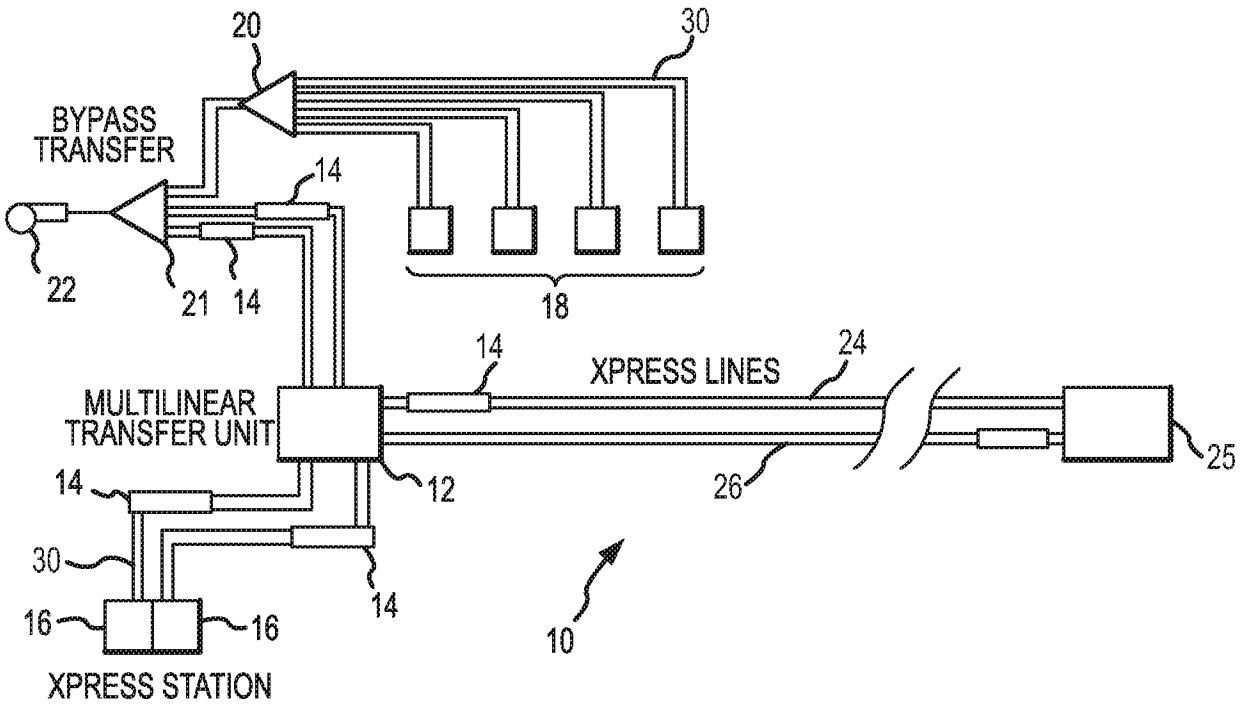
FIG. 1 illustrates an exemplary pneumatic system.

FIG. 1 illustrates one exemplary embodiment of a pneumatic transport system. In general, the pneumatic carrier system 10 transports pneumatic carriers between various user stations 16, 18. At each of the user stations 16, 18, a user may insert a carrier, select/enter a destination address/identification and a transaction priority, and then send the carrier. The system determines an optimum path to route the carrier and begins directing the carrier through the system.

Interconnected with each station 16, 18 of the exemplary system 10 is a transfer unit 20 which orders carriers arriving through different tubes 30 from a different station 16, 18 into a single pneumatic tube. This pneumatic tube is further in connection with a vacuum by-pass transfer unit 21 (i.e., a turn around transfer unit) and a blower 22 that provides the driving pneumatic force for carrier movement. A set of transfer units 20, 21, a blower 22 and one or more stations 16, 18 may define a single zone. Generally, the blower 22 of each zone is operative to create pressure and/or vacuum (i.e., system pressure) within the pneumatic tube(s) of that zone. This pressure/vacuum creates a pressure differential across a carrier disposed within the pneumatic tube and thereby causes the carrier to move through the pneumatic tube.

Also illustrated in the present embodiment are first and second express tubes 24, 26, which interconnect a remote facility 25 to the pneumatic system 10. In various system configurations, pneumatic systems transport materials over considerable distances, which may exceed, for example, one or more miles. In such long distance transports, it may be desirable to increase the transport speed of the carriers.

Within the system 10, one or more devices are employable for ordering and routing carriers to their selected destinations. One type of device is a traffic control unit (TCU) 14, which is employable to receive, temporarily store and release a number of carriers. Also included in the system 10 are multi-linear transfer units (MTUs) 12 which have functionality to direct carriers from one pneumatic tube to another pneumatic tube (e.g., between tubes in single zone or between different zones). A system central controller connects all of the components described in FIG. 1 and controls their operation. The system central controller provides centralized control for the entire pneumatic carrier system and generally includes a digital processing and memories archives.

Carriers

Figure 2A:
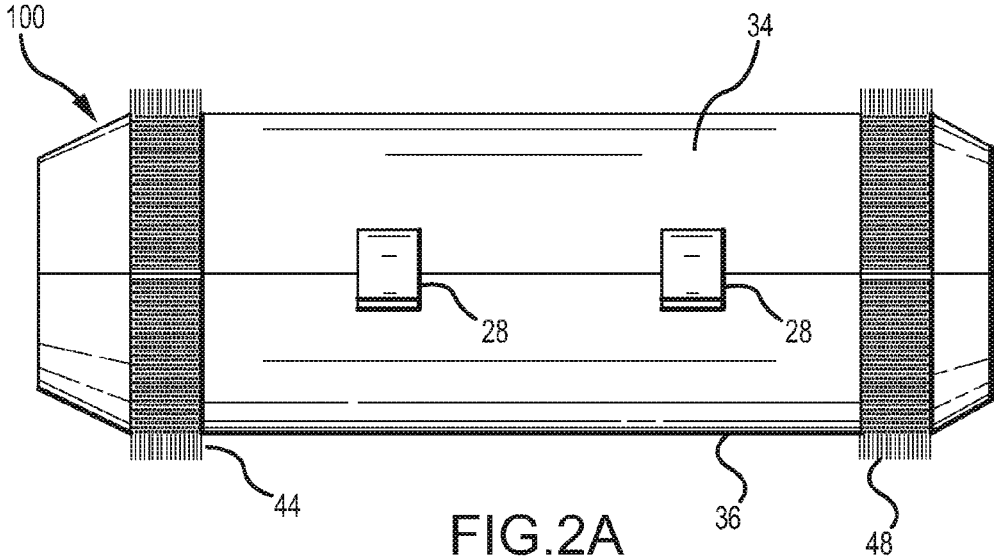
FIGS. 2A and 2B illustrate a first embodiment of a pneumatic carrier.
Figure 2B:
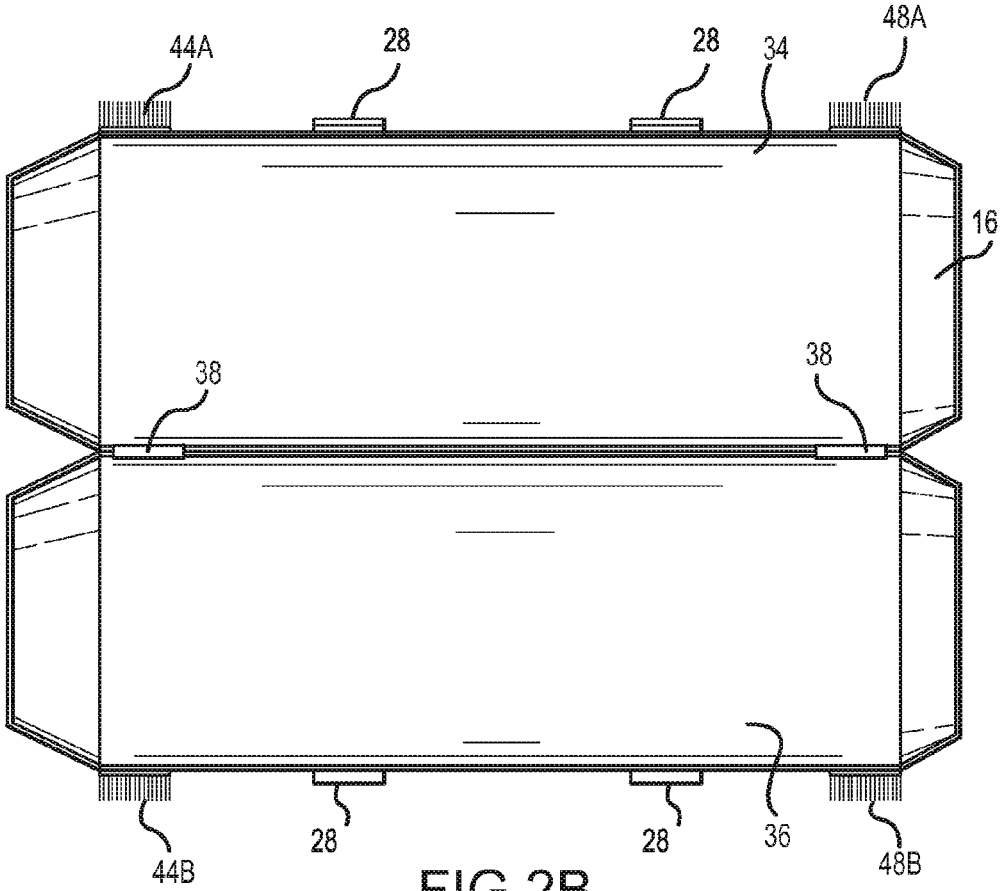

FIGS. 2A and 2B illustrate one type of carrier 100 utilized with pneumatic transport systems. As illustrated, the carrier 100 is a side-opening carrier that is positionable between an open configuration for loading cargo as shown in FIG. 2B and a closed configuration for transport through the system 10 as shown in FIG. 2A. The carrier 100 includes a first shell member 34 and a second shell member 36 that collectively define an enclosed space (not shown) for use in carrying the cargo through the system 10. The first and second shell members 34, 36 are generally adjoinably cylindrical in cross-section for use in correspondingly cylindrical pneumatic tubes of the system 10. At least one hinge member 38 pivotally interconnects the first and second shell members 34, 36 for movement between the open and closed configurations. A latch 28 secures the first and second shell members 34, 36 in the closed configuration.

Included as part of the carrier 100 are forward wear band 44 and a rear wear band 48. In the illustrated side-opening carrier, forward wear band halves 44*a*, 44*b* and rearward wear halves bands 48*a*, 48*b* define the wear bands. As shown, the wear band halves are disposed on the outside surface of each of the shell members and form a substantially continuous ring about the outside surface of the carrier when the first and second shells are closed. The wear bands 44, 48 are sized to fit snuggly within the inside surface of the pneumatic tubes of the system 10 and substantially block air passage across the carrier. By substantially blocking the passage of air across the carrier 100, the first and second wear bands 44, 48 allow for creating a pressure differential across the carrier 100, which causes air pressure or vacuum to push or draw the carrier 100 through the pneumatic tubes of the system 10.

Figure 3A:
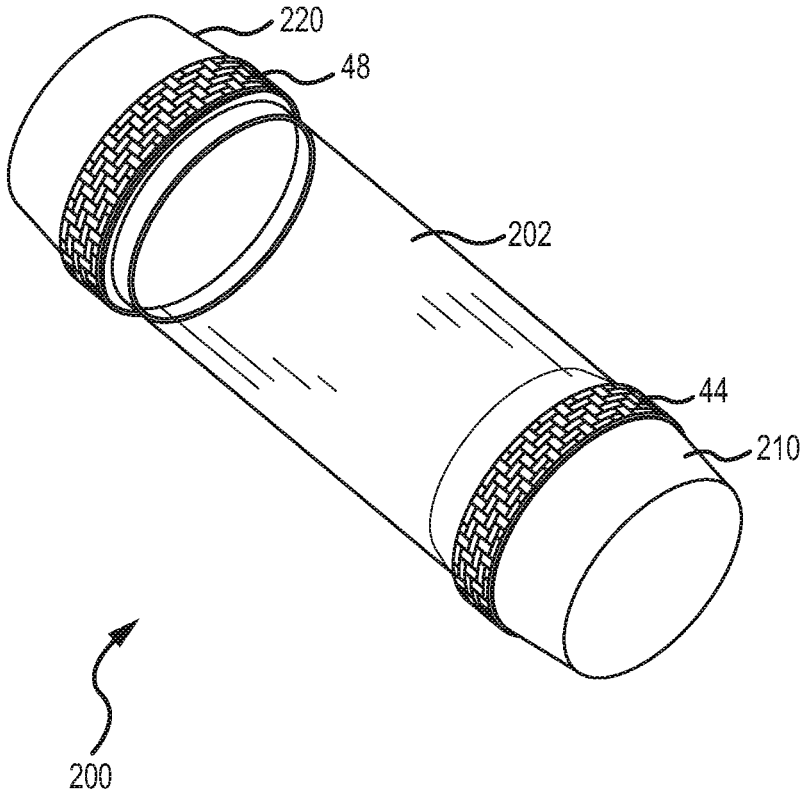
FIGS. 3A and 3B illustrate a second embodiment of a pneumatic carrier.

FIG. 3 illustrates another carrier 200 for use in a pneumatic transport system. As shown, the carrier is an end-opening carrier 200. The carrier 200 includes a tubular body 202 having first and second ends disposed in forward and rear end cap assemblies 210, 220. Each end cap assembly may include an openable cap (not illustrated). These openable caps pivot to an open position to allow access to the interior of the tubular body 202 of the carrier 200 via the end of the carrier. The end cap assemblies each include an annular groove or race sized to receive a wear band 44 or 48 to seal against the interior of the tubes as the carrier travels. Typically, such wear bands are elongated members extending around the end cap. In such an arrangement, first and second ends of the elongated member abut. In other arrangements, the wear band may be a unitary annular member.

High Speed/Heavy Load Applications

Most pneumatic tube systems transport carriers at relatively slow speeds, generally between about 15 ft/sec and about 20 ft/sec. In such systems, the frictional forces between the wear bands of the carriers and the pneumatic tubes of the system are low enough that significant heat build up is not a concern. Accordingly, various wear band materials are adequate for sealing purposes. However, in applications where delivery distances are large and/or delivery speed is critical, it is desirable to transport pneumatic carriers at increased speeds. For instance, nuclear medicine imaging techniques, such as positron emission tomography (PET), administer radioactive substances to patients and image emitted radiation to produce three-dimensional images of functional processes in the body. These systems detect gamma rays from positron-emitting radionuclide/radioisotopes (tracers) introduced into the body on a biologically active molecule. Radionuclides used in PET scanning have short half-lives and are typically produced in a remote radiochemistry laboratory using a cyclotron. Due to the short half-lives of these radioisotopes, it is necessary to quickly deliver the radiotracers to the imaging facility. In such applications, delivery speeds of carriers including such materials may be significantly increased, e.g., speeds of 45-55 ft/sec or higher. Likewise, when transporting carrier over longer distances such higher speeds are desirable. As will be appreciated, increased speed results in increased heat build-up between the wear bands and the pneumatic tubes.

Heavy payloads further complicate pneumatic transfers. That is, increasing the weight carried by a pneumatic carrier increases the normal force between the bearing surface of the wear band and the inside surface of the pneumatic tubes. This further increases heat generated during transport through a pneumatic tube. Referring again to the PET imaging example, metal shielding is often disposed within carriers carrying radioisotopes. Accordingly, the resultant carrier may be very heavy. For instance, a six-inch diameter carrier including such metal shielding may weigh in excess of fifteen or twenty pounds. In addition, such heavy carriers require a seal/wear band(s) having enough structural integrity that it does not crush or deform under the weight of the carrier, which may allow air to bypass the carrier.

In such applications where high speeds and/or heavy payloads are utilized (hereafter heavy duty applications), it has been determined that existing wear bands may structurally fail. That is, the frictional forces caused by high speeds or heavy loads results in heat build-up that melts or otherwise compromises conventional wear band(s). In addition to melting, for example polymeric wear bands, such heavy-duty applications also tend to increase the wear rate of the wear bands even in the absence of melting. That is, even if a conventional wear band is able to withstand the temperatures generated in heavy-duty applications, the increased temperature and rubbing speeds reduce the service life of such wear bands.

In view of these concerns, a desirable wear band would have structural integrity at elevated temperatures, good wear properties at elevated temperatures and be flexible to accommodate variations in the diameter and/or ovality of pneumatic transport tubes. In the latter regard, a number of materials provide adequate structural integrity and wear properties, but fail to provide the necessary flexibility to accommodate variations in the pneumatic tubes. Stated otherwise, most materials having the desired characteristics are too rigid for use as a wear band.

Figure 4:
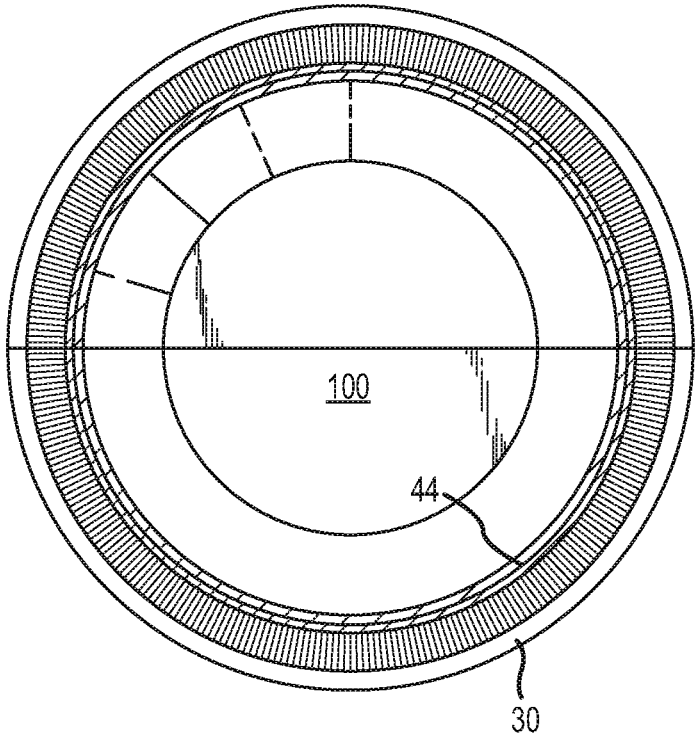
FIG. 4 illustrates a pneumatic carrier supported within a pneumatic tube.

The present inventor has also recognized that the ability to remove heat from areas of heat build-up within the wear band improves wear characteristics and structural integrity thereof. FIG. 4 illustrates a cross-sectional view of a carrier 100 as disposed within a pneumatic tube 30. As shown, the wear band 44 suspends the main body of the carrier 100 in a spaced relationship from the inside surface of the tube 30. In an arrangement where the bottom of the tube is down, the region of the wear band 44 disposed between the bottom of the carrier body and the bottom third or so of the tube 30 supports most or all of the weight of the carrier 100 and the contents therein. In this regard, this weight supporting region of the wear band 44 will have the highest normal forces and therefore generate the most heat during transport. Dissipating heat from this high heat region to other portions of the wear band enhances the structural integrity of the wear band.

Figure 5:
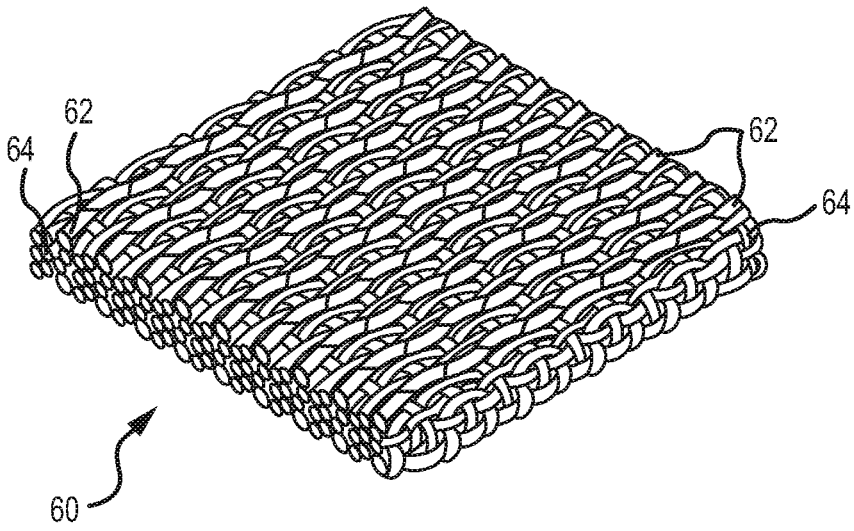
FIG. 5 illustrates a metal impregnated woven fabric of heavy duty a wear band.

In one embodiment, the carrier incorporates one or both wear bands that have thermally conductive textiles or fabrics to conduct heat about the periphery of the wear band(s). This thermally conductive textile includes a plurality of thermally conductive elements within its structure. One particular embodiment utilizes a metallic wire impregnated textile. As illustrated in FIG. 5, such a textile 60 may include a plurality of wires 62 that are disposed through and/or weaved within a fabric/fibers 64. In one particular embodiment, aramid fibers are woven with brass wires to produce a heat and wear resistant textile.

In an arrangement, at least a portion of the wires 62 may be aligned in the textile 60 such that they extend around a portion of the circumference of the carrier body and can thereby conduct heat away from the weight supporting region (i.e., region of high friction). Preferably, at least a portion of the wires extend the length of the wear band (i.e., from a first end to a second end). This, in effect, provides a cooling mechanism for the wear band 44.

In any arrangement, it is desirable that at least a portion of the wires extend around at least a quarter or a third of the circumference of the carrier. This allows for conducting heat from a weight bearing portion of the wear band (e.g., beneath the carrier) to a non weight bearing portion of the wear band.

It will be appreciated that other embodiments may utilize other conductive elements. For instance, some applications may utilize carbon fiber impregnated fabrics to provide thermal conductivity. Any material having a thermal conductivity of greater than about 15 w/mK may be utilized. However, for most wear applications, metal impregnated textiles or fabrics provide improved wear characteristics as well as higher thermal conductivity (e.g., in excess of 50 w/mK). In arrangements where metal fibers are incorporated, it may be desirable that the metal utilized within the fabric have a hardness that is less than the hardness of the pneumatic tubes through which the carrier passes. This may prevent the wear bands from abrading the inside surfaces of the pneumatic tubes. Furthermore, some materials (e.g., brass) may provide lubrication for the carrier in high wear applications. That is, if highly localized temperatures (e.g., the contact point between the wire and the pneumatic tube) exceed the melting point of the impregnated metal fibers, a portion of these fibers may melt/evaporate to provide lubrication for the carrier. However, this is not a requirement.

Figure 6:
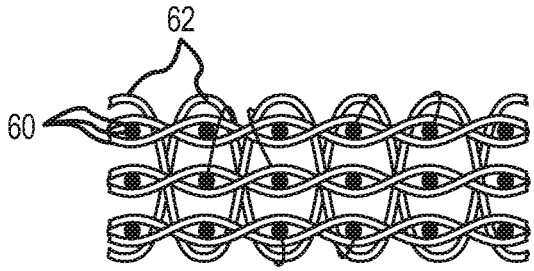
FIG. 6 illustrates a cross-sectional view of the fabric of FIG. 5.

As illustrated in FIG. 5, it may be desirable that the thermally conductive textile be a woven fabric. In this regard, the contact area between the wear band and the inside surface of the pneumatic tube may be reduced due to the uneven surface of the woven fabric. FIG. 6 illustrates a cross-sectional view of such a woven material. As illustrated, depressions between yarns within the fabric 60 do not contact the surface of the pneumatic tube when utilized in a wear band. In this regard, use of a woven fabric allows for reducing the surface area contact between these elements. This reduces the overall friction between the wear band and the pneumatic tube.

Figure 3B:
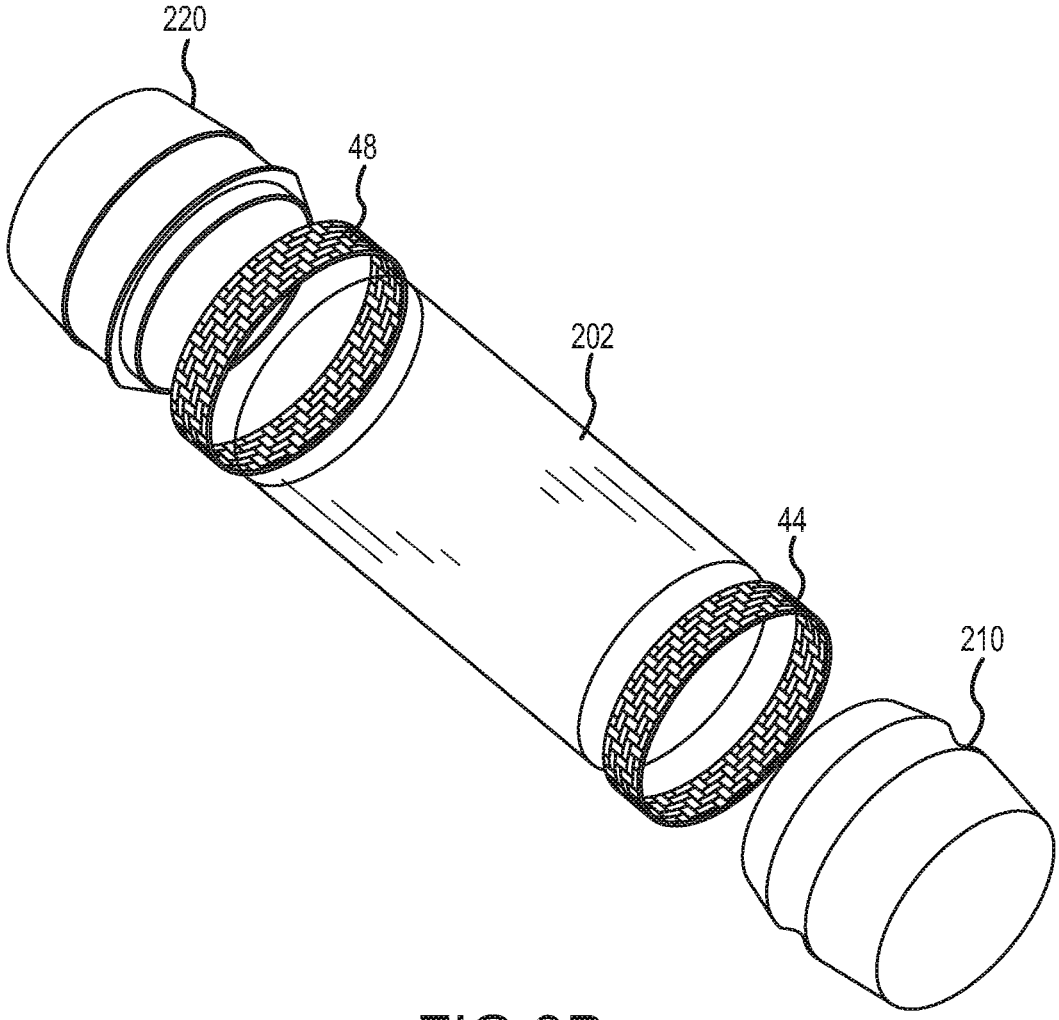

Commercially available materials that provide some or all of the above-noted characteristics include various brake and clutch lining materials. Such materials include, without limitation, non-asbestos woven linings made up of a mixture of resins, oils, numerous fibers and wire-inserted yarns. One particular product by Ceco Friction Products, Inc. style 310 NAW utilizes brass wire inserted yarns. The material has a coefficient of friction below 0.4, an operating temperature over 500 degrees Fahrenheit, high tensile strength and the ability to hold rivets. In this latter regard, it will be appreciated that interconnection of the wear band to the carrier body may be performed utilizing rivets, bolts or other fastening methods. As illustrated in FIG. 3B, the end cap assembly of the carrier includes various holes that allow for riveting the wear bands directly to the end caps. Accordingly, it is desirable that the material allows direct physical interconnection to the carriers.

While seeming counter-intuitive to utilize a brake/friction lining as a wear or seal band for a pneumatic tube transport, it has been determined that such materials typically provide high friction only in braking and clutch type applications. Such friction occurs in part to the large compressive forces between the linings and, for example, a brake drum, as well as the extremely high rubbing speeds (e.g., 500 ft/sec) associated with these applications. In the present application, while supporting the weight of the carrier, such large compressive forces and high rubbing speeds are simply absent. Accordingly, these materials do not provide significant resistance in pneumatic carrier wear band applications and do provide flexibility that allows the wear bands to accommodate variations in the pneumatic tubes. Further, due to the intended application of such brake/friction linings, these materials are generally heat resistant and thereby have excellent wear properties at elevated temperatures.

The foregoing description of the system has been presented for purposes of illustration and description. Furthermore, the description is not intended to limit the invention to the form disclosed herein. Consequently, variations and modifications commensurate with the above teachings, and skill and knowledge of the relevant art, are within the scope of the invention. The embodiments described hereinabove are further intended to explain best modes known of practicing the invention and to enable others skilled in the art to utilize the invention in such or other embodiments and with various modifications required by the particular application(s) or use(s) of the invention. It is intended that the appended claims be construed to include alternative embodiments to the extent permitted by the prior art.

The invention claimed is:

1. A carrier for use in a tube transport system comprising at least one pneumatic tube, said carrier comprising:

a generally cylindrical containment vessel which defines an enclosed space and which includes a first access to said enclosed space, wherein said cylindrical containment vessel is sized and shaped for advancement through a pneumatic tube;

first and second seal bands interconnected with an outer surface of said containment vessel and substantially encircling said containment vessel at first and second spaced locations, wherein said first and second seal bands are sized for substantially conformal engagement with an inside surface of the pneumatic tube, wherein said at least one seal band comprises:

a wire impregnated textile material, wherein brass wires interwoven with non-metallic fibers within said wire impregnated textile material extend about a portion of the circumference of said containment vessel.

2. The carrier of claim 1, wherein said seal bands are substantially circular about said outside surface and wherein at least a portion of said wires in said seal band comprising a wire impregnated textile material extend continuously about at least two radians of said substantially circular seal band.

3. The carrier of claim 1, wherein said wire impregnated textile comprises:

a woven textile, wherein said brass wires are interwoven with non-metallic fibers.

4. The carrier of claim 3, wherein said non-metallic fibers comprise aramid fibers.

5. The carrier of claim 3, wherein said non-metallic fibers are organic fibers.

6. The carrier of claim 1, wherein said generally cylindrical containment vessel comprises:

first and second concave shells for engagement in a closed position, said first and second concave shells defining the enclosed space in said closed position;

hinge means coupled to the first and second shells, said hinge adapted to permit movement of the first and second shells between said closed position and an open position; and a latch for selectively maintaining said shells in the closed position.

7. The carrier of claim 6, wherein said seal bands each comprise:

a first portion attached to an outside surface of said first concave shell; and a second portion attached to an outside surface of said second concave shell, wherein said first and second portions collectively encircle said containment vessel when said first and second shells are in said closed position.

8. The carrier of claim 1, wherein said generally cylindrical containment vessel comprises:

a tubular body; and at least one end cap assembly having a openable cap, wherein said first access is through an end of said generally cylindrical body.

9. The carrier of claim 8, wherein said seal bands extend continuously about said outside surface of said containment vessel between first and second abutting ends of the seal band.

10. The carrier of claim 1, wherein said brass wires have a Rockwell hardness that is less than the Rockwell hardness of the pneumatic tube.

11. A carrier for use in a tube transport system comprising at least one pneumatic tube, said carrier comprising:

a generally cylindrical containment vessel which defines an enclosed space and which includes a first access to said enclosed space, wherein said cylindrical containment vessel is sized and shaped for advancement through a pneumatic tube;

first and second seal bands interconnected with an outer surface of said containment vessel and substantially encircling said containment vessel at first and second spaced locations, wherein said first and second seal bands are sized for substantially conformal engagement with an inside surface of the pneumatic tube and wherein at least one of said first and second seal bands comprises:

a woven textile material having a first set of fibers extending about a portion of the circumference of said containment vessel, wherein at least a first portion of said first set of fibers include a plurality of brass wires have a thermal conductivity of at least 15 (W/mK).

12. The carrier of claim 11, wherein a second portion of said first set of fibers comprises at least one of carbon fibers; and graphite fibers.

13. The carrier of claim 9, wherein said generally cylindrical containment vessel comprises:

a tubular body; and at least one end cap assembly having a openable cap, wherein said first access is through an end of said generally cylindrical body.

14. The carrier of claim 13, wherein said seal bands extend continuously about said outside surface of said containment vessel between first and second abutting ends of the seal band.

* * * * *